US006529166B2

(12) United States Patent
Kanamaluru

(10) Patent No.: US 6,529,166 B2
(45) Date of Patent: Mar. 4, 2003

(54) ULTRA-WIDEBAND MULTI-BEAM ADAPTIVE ANTENNA

(75) Inventor: Sridhar Kanamaluru, West Windsor, NJ (US)

(73) Assignee: Sarnoff Corporation, Princeton, NJ (US)

( * ) Notice: Subject to any disclaimer, the term of this patent is extended or adjusted under 35 U.S.C. 154(b) by 47 days.

(21) Appl. No.: 09/818,445

(22) Filed: Mar. 27, 2001

(65) Prior Publication Data

US 2002/0140616 A1 Oct. 3, 2002

Related U.S. Application Data

(60) Provisional application No. 60/234,585, filed on Sep. 22, 2000.

(51) Int. Cl.[7] ..... H01Q 13/00; H01Q 21/28

(52) U.S. Cl. ..... 343/700 MS; 343/824

(58) Field of Search ..... 343/700 MS, 824, 343/727, 776; 342/375; 338/306

(56) References Cited

U.S. PATENT DOCUMENTS

| | | | | |
|---|---|---|---|---|
| 3,761,943 A | | 9/1973 | Harper et al. | 343/776 |
| 3,771,158 A | | 11/1973 | Hatcher | 343/728 |
| 4,189,733 A | | 2/1980 | Malm | 343/100 SA |
| 4,862,180 A | | 8/1989 | Martin | 342/417 |
| 4,864,310 A | | 9/1989 | Bernhard et al. | 342/368 |
| 4,916,454 A | | 4/1990 | Bull et al. | 342/373 |
| 5,126,716 A | * | 6/1992 | Munger | 338/306 |
| 5,434,580 A | | 7/1995 | Raguenet et al. | 343/700 MS |
| 5,493,304 A | | 2/1996 | Lee et al. | 342/360 |
| 5,592,178 A | | 1/1997 | Chang et al. | 342/372 |
| 5,757,319 A | | 5/1998 | Loo et al. | 342/375 |
| 5,838,282 A | * | 11/1998 | Lalezari et al. | 343/727 |
| 5,852,687 A | | 12/1998 | Wickham | 385/14 |
| 5,859,614 A | | 1/1999 | Paolella et al. | 343/700 MS |
| 5,874,915 A | | 2/1999 | Lee et al. | 342/375 |
| 5,933,113 A | | 8/1999 | Newberg et al. | 342/375 |
| 6,023,251 A | | 2/2000 | Koo et al. | 343/895 |
| 6,023,462 A | | 2/2000 | Nieczyporowicz et al. | 370/335 |
| 6,100,843 A | | 8/2000 | Proctor, Jr. et al. | 342/368 |
| 6,266,011 B1 | * | 7/2001 | Hong | 342/375 |

FOREIGN PATENT DOCUMENTS

| | | |
|---|---|---|
| EP | 0 372 451 | 6/1990 |
| WO | WO 99/17397 | 4/1999 |

OTHER PUBLICATIONS

PCT Search Report, PCT/US 01/29255, international filing date Sep. 18, 2001.

* cited by examiner

*Primary Examiner*—Don Wong
*Assistant Examiner*—James Clinger
(74) *Attorney, Agent, or Firm*—William J. Burke

(57) ABSTRACT

An ultra-wideband, multi-beam adaptive antenna includes a phased array system having an ultra-wideband antenna. The antenna further includes at least two sub-arrays of antenna elements for receiving radio frequency (RF) signals located in a respective at least two sub-bands of a desired wide frequency band. The sub-arrays are interspersed to provide a single wideband antenna, which is coupled with a phased array system having multiple beamforming networks.

17 Claims, 3 Drawing Sheets

ULTRA-WIDEBAND MULTI-BEAM ADAPTIVE ANTENNA

CROSS-REFERENCE TO RELATED APPLICATIONS

This application claims benefit of U.S. provisional patent application Ser. No. 60/234,585, filed Sep. 22, 2000, which is herein incorporated by reference.

GOVERNMENT RIGHTS IN THIS INVENTION

This invention was made with U.S. government support under contract number 73010 NMA202-97-D-1033/0019. The U.S. government has certain rights in this invention.

BACKGROUND OF THE INVENTION

1. Field of the Invention

The invention generally relates to phased array antenna systems and, more particularly, the invention relates to an ultra-wideband, multi-beam phased array antenna.

2. Description of the Related Art

Phased array antennas exhibit desirable properties for communications and radar systems, the salient of which is the lack of any requirement for mechanically steering the transmission beam. This feature allows for very rapid beam scanning and the ability to direct high power to a target from a transmitter, or receive from a target with a receiver, while minimizing typical microwave power losses. The basis for directivity control in a phased array antenna system is wave interference. By providing a large number of sources of radiation, such as a large number of equally spaced antenna elements fed from a combination of in-phase currents, high directivity can be achieved. With multiple antenna elements configured as an array, it is therefore possible, with a fixed amount of power, to greatly reinforce radiation in a desired direction.

A significant feature of present adaptive phased array antenna systems is that they are typically narrowband. New applications for phased array antenna systems constantly push the design envelope for increasingly higher transmission frequencies and wider bandwidths. Increasing the transmission frequency, however, requires that radiating elements be placed in increasingly closer and closer proximity to one another. At the same time, the antenna element size is dictated by the lowest frequency of operation. It is found that as both the frequency of transmission and bandwidth increase, the use of multi-beam arrayed configurations of antenna system elements becomes limited by the physical space required to incorporate the system elements.

Therefore, there exists a need in the art for an ultra-wideband antenna aperture for phased array systems.

SUMMARY OF THE INVENTION

The disadvantages associated with the prior art are overcome by an ultra-wideband, adaptive antenna having a first sub-array of antenna elements disposed so as to receive RF signals located in a first sub-band of a desired frequency band, and one or more additional sub-arrays of antenna elements interspersed within the first sub-array so as to receive RF signals located in a respective one or more sub-bands of the desired frequency band. In one embodiment, the desired frequency band is divided into three sub-bands and the antenna comprises a low-, a mid-, and a high-frequency sub-array for receiving RF signals in each sub-band. The interspersed structure of the present invention allows for a signal antenna aperture for ultra-wideband phased array antenna systems.

BRIEF DESCRIPTION OF THE DRAWINGS

So that the manner in which the above recited features of the present invention are attained and can be understood in detail, a more particular description of the invention, briefly summarized above, may be had by reference to the embodiments thereof which are illustrated in the appended drawings.

It is to be noted, however, that the appended drawings illustrate only typical embodiments of this invention and are therefore not to be considered limiting of its scope, for the invention may admit to other equally effective embodiments.

DETAILED DESCRIPTION OF THE PREFERRED EMBODIMENT

Figure 1:
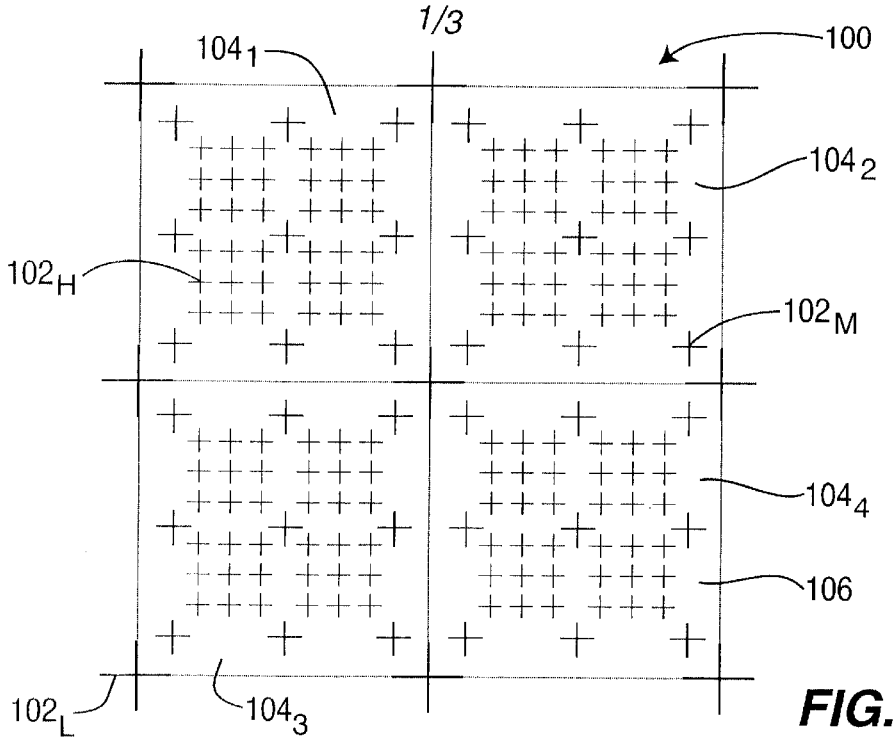
FIG. 1 depicts an ultra-wideband, phased array antenna in accordance with the present invention.

FIG. 1 depicts an ultra-wideband, phased array antenna 100 comprising a plurality of unit cells $\mathbf{104}_n$ (where n is an integer and four cells are illustratively depicted as cells $\mathbf{104}_1$, $\mathbf{104}_2$, $\mathbf{104}_3$, and $\mathbf{104}_4$). Those skilled in the art will realize that the 2×2 cell antenna is illustrative of the various arrangements of cells and the various numbers of cells that can be used to form an antenna in accordance with the teachings of the present invention.

Each unit cell $\mathbf{104}_n$ comprises a low-frequency sub-array 102L, a mid-frequency sub-array 102M, and a high-frequency sub-array 102H. Each sub-array 102L, 102M, and 102H comprises a plurality of antenna elements. In the illustrative embodiment, the sub-array 102L comprises a 2×2 array of antenna elements, the sub-array 102M comprises a 3×3 array of antenna elements, and the sub-array 102H comprises a 6×6 array of antenna elements. As discussed above, the unit cells $\mathbf{104}_n$ can be arranged in various formations, which in turn causes each sub-array 102L, 102M, and 102H of each cell $\mathbf{104}_n$ to be combined to provide as many antenna elements as is necessary for a given application.

The antenna elements may be linearly polarized, such as dipoles, bow-ties, cross dipoles, or micro-strip patches; circularly polarized, such as spirals; or other radiating elements that are known in the art. The individual antenna elements are formed by patterned metallization deposition on a substrate 106 using conventional planar antenna element fabrication techniques. The antenna elements of the mid-frequency sub-array 102M are interspersed within the low-frequency sub-array 102L, and the elements of the high-frequency sub-array 102H are interspersed within the mid-frequency sub-array 102M. Each sub-array 102L, 102M, and 102H is capable of receiving radio frequency (RF) signals located in a low-frequency, a mid-frequency, and a high-frequency sub-band of a desired frequency band, respectively. As such, the antenna 100 is capable of receiving RF signals located in the entire desired frequency band.

For example, the antenna 100 could be adapted for use with a phased-array system having a bandwidth of 300 MHz to 12.4 GHz (i.e., a 40:1 bandwidth). The low-, mid-, and high-frequency sub-bands could be 300 MHz to 1.0 GHz, 1.0 GHz to 3.5 GHz, and 3.5 GHz to 12.4 GHz, respectively. That is, each sub-band would have approximately 3.5:1 bandwidth. Each sub-array 102L, 102M, and 102H would then operate with a bandwidth of approximately 3.5:1, which would allow each sub-array to satisfy the element size and inter-element distance requirements known to those skilled in the art for receiving RF signals. Thus, the elements of each of the sub-arrays 102L, 102M, and 102H would be disposed in a spaced-apart relation, where each element is spaced less than one-half of one free-space wavelength apart from its neighboring elements. A wavelength is defined by the highest frequency present in the respective sub-band. If some grating lobes in the radiation pattern are allowed when the beam is scanned from the boresight, however, then the elements of each sub-array 102L, 102M, and 102H can be spaced further than one-half of one free-space wavelength. In an alternative embodiment, the elements of each sub-array 102L, 102M, and 102H can be disposed in a pseudo-random manner to circumvent the inter-element distance requirement while suffering slight degradation of the antenna patterns.

Because the antenna element size shrinks as the frequency of operation increases, the mid-frequency sub-array 102M can be interspersed with the low-frequency sub-array 102L, and the high-frequency sub-array 102H can be interspersed with the mid-frequency sub-array 102M. Thus, a single antenna 100 can be formed having the required 40:1 bandwidth. The unit cell $\mathbf{104}_n$ as shown in FIG. 1 can be repeated as many times as is required for a given application.

Although the antenna 100 of the present invention has been described with three sub-arrays (i.e., the low-, mid-, and high-frequency sub-arrays 102L, 102M, and 102H), those skilled in the art could devise further configurations using two or more interspersed sub-arrays operating in different sub-bands of a desired frequency band. Furthermore, although the antenna 100 has been described in receiving mode, it is understood by those skilled in the art that the present invention is useful for both transmitting and receiving modes of operation.

Figure 2A:
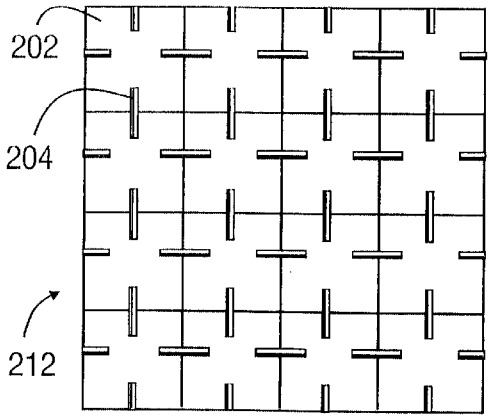
FIG. 2A depicts a top view of a high-impedance surface structure.
Figure 2B:
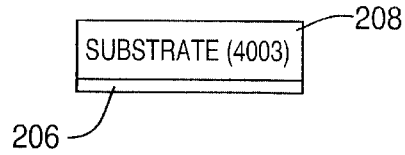
FIG. 2B depicts a cross-sectional view of the high-impedance surface structure.
Figure 2C:
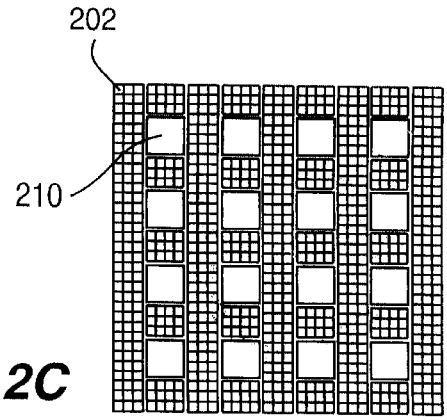
FIG. 2C depicts a high-impedance surface structure with a planar array of elements.

In some applications, mutual coupling between antenna elements of a sub-array and/or between elements of different sub-arrays may have a detrimental affect on the antenna patterns of the array. FIGS. 2A, 2B, and 2C depict a high impedance (high-Z) surface structure 212 that can be used to reduce the propagation of surface-wave modes that can cause coupling between antenna elements. FIG. 2A depicts a top view and FIG. 2B depicts a cross-sectional view of the high-Z surface structure 212. FIG. 2C depicts the high-Z surface structure 212 in use with a planar array of antenna elements 210.

Referring to FIGS. 2A and 2B, the high-Z surface structure 212 comprises a multiplicity metallic patches 202, a metal ground plane 206, and a substrate 208. The metallic patches 202 are disposed, in a spaced-apart relation, on the substrate 208 in a planar array formation. Each of the metallic patches is connected to its respective adjacent patches by a thin transmission line 204. The metal ground plane 206 backs the substrate 208. The close spacing between the metal patches 202 functions as a capacitance, while one of the transmission lines 204 functions as an inductance. Together, the capacitance and inductance function as a parallel resonant circuit. The multitude of patches 202 and transmission lines 204 corresponds to a cascaded parallel tuned circuit. At the resonant frequency of the tuned circuit, the series impedance is very high and the signal (surface wave) does not propagate through the substrate 208. The dimensions of the high-Z surface structure 212 controls the frequency of resonance.

The high-Z surface structure 212 can be used with the ultra-wideband antenna 100 shown in FIG. 1. In the embodiment shown in FIG. 2C, each of the low-, mid-, and high-frequency sub-arrays 102L, 102M, and 102H comprise an array of micro-strip patches 210 (a exemplary 4×4 array is shown), which are disposed on the high-Z surface structure 212. For simplicity, FIG. 2C depicts only one of the sub-arrays 102L, 102M, and 102H, for example, the high-frequency sub-array 102H. As described above, the high-frequency sub-array 102H is interspersed within the low- and mid-frequency sub-arrays 102L and 102M. The high-Z surface structure 212 reduces mutual coupling between elements of a sub-array and/or between elements of different sub-arrays.

Figure 3:
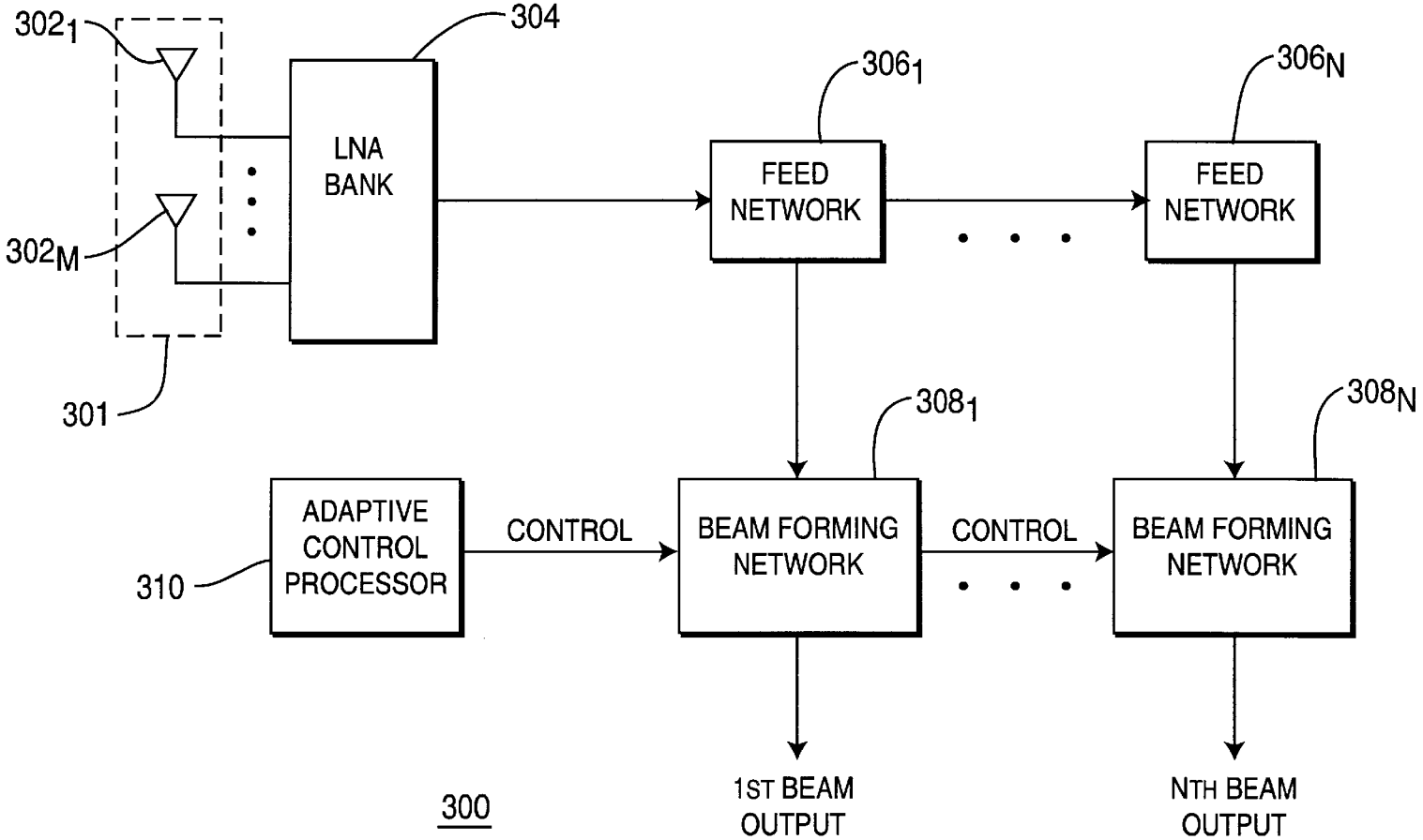
FIG. 3 depicts a high-level block diagram of a phased array system having an ultra-wideband antenna of the present invention.
Figure 4:
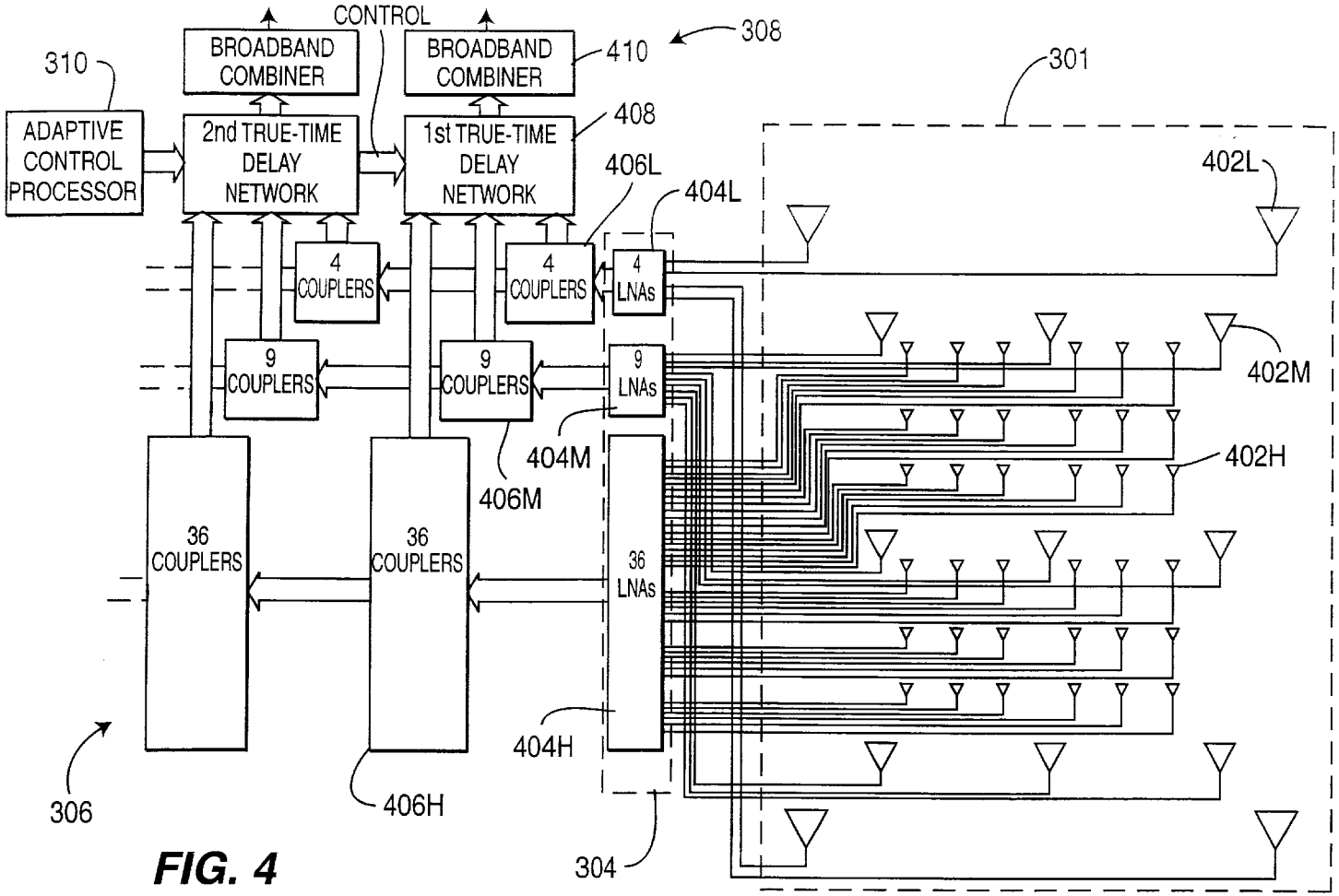
FIG. 4 depicts a detailed block diagram of one embodiment of the phased array system of FIG. 3.

FIG. 3 depicts a high-level block diagram of an adaptive multi-beam, multi-null phased array system 300. FIG. 4 depicts a detailed block diagram of one embodiment of the phased array system 300. Referring to FIG. 3, the phased-array system 300 comprises an ultra-wideband antenna 301 having M sub-arrays of antenna elements 302, a low noise amplifier (LNA) bank 304, N feed networks 306, N beamforming networks 308, and an adaptive control processor 310. As described above with regard to FIG. 1, each of the M sub-arrays of elements 302 is capable of receiving RF signals located in a respective one of M sub-bands of a desired frequency band.

By way of illustration, sub-array $\mathbf{302}_1$ receives an RF signal located in a first sub-band of the desired frequency band. Each element of the sub-array $\mathbf{302}_1$ couples the received RF signal to the LNA bank 304 for amplification. The signals must be amplified before they are split and coupled to the N beamforming networks 308. The LNA bank 304 couples the signals received by each element of the sub-array $\mathbf{302}_1$ to the first feed network $\mathbf{306}_1$. The feed network $\mathbf{306}_1$ couples the signals to the first beamforming network $\mathbf{308}_1$ and to the next feed network in the chain of N feed networks 306. The coupling process is repeated until feed network $\mathbf{306}_N$ couples the signals to beamforming network $\mathbf{308}_N$. Each of the N beamforming networks 308 spatially process the RF signals in accordance with the adaptive control processor 310 in a well-known manner. The outputs of the beamforming networks 308 are the N output beams of the phased array system 300.

In the embodiment shown in FIG. 4, the ultra-wideband antenna 301 (only one cell thereof is shown for simplicity) comprises a low-frequency sub-array 402L, a mid-frequency sub-array 402M, and a high-frequency sub-array 402H. Each of the sub-arrays 402L, 402M, and 402H is configured to receive RF signals in a respective sub-band of the desired frequency band as previously described. The elements of the sub-arrays 402L, 402M, and 402H are coupled to LNA groups 404L, 404M, and 404H of the LNA bank 304, respectively. The LNA groups 404L, 404M, and 404H amplify the signals and couple them to the feed network $\mathbf{306}_1$. Each of the feed networks 306 comprises three groups of couplers 406L, 406M, and 406H. The couplers 406L, 406M, and 406H are broadband and have low insertion losses. The couplers 406L, 406M, and 406H of the feed network 3061 split the amplified signals among the beamforming network 308, and the respective couplers 406L, 406M, and 406H in the next feed network in the chain of N feed networks 306. The coupling from each antenna element is not necessarily the same so as to enable amplitude tapers to be inserted. The coupling process is repeated until the couplers 406L, 406M, and 406H of feed network $\mathbf{306}_N$ couple the signals to beamforming network $\mathbf{308}_N$.

Each beamforming network 308 comprises a true-time delay (TTD) network 408 and a broadband combiner 410. As known to those skilled in the art, the TTD network 408 comprises multiple lengths of transmission lines to control the time of arrival of the signals from the various antenna elements. By controlling the time of arrival, the beams can be scanned over a wide frequency range. The adaptive control processor 310 dynamically controls the TTD network 408 of each beamforming network 308, making the phased array adaptive. The broadband combiner 410 spatially combines the outputs of the TTD network to from an output beam. Each of the beamforming networks 408 is controlled independently by the adaptive control processor 410 to generate different output beams.

While foregoing is directed to the preferred embodiment of the present invention, other and further embodiments of the invention may be devised without departing from the basic scope thereof, and the scope thereof is determined by the claims that follow.

What is claimed is:

1. An antenna array comprising:

a plurality of unit cells, each unit cell including:

first array of antenna elements; and at least one additional array of antenna elements, interspersed within said first array of antenna elements;

wherein said unit cells are disposed such that said first arrays collectively form a first sub-array to receive a radio frequency (RF) signal in a first sub-band of a frequency band, and said at least one additional arrays collectively form a respective at least one additional sub-array to receive said RF signal in a respective at least one remaining sub-band of said frequency band.

2. The antenna of claim 1 wherein the antenna elements of said first sub-array and said at least one sub-array are selected from the group consisting of dipole elements, bow-tie elements, spiral elements, and micro-strip patches.

3. The antenna of claim 1 wherein the antenna elements of said first sub-array and said at least one sub-array are disposed one-half of one free-space wavelength apart.

4. The antenna of claim 1 wherein the antenna elements of said first sub-array and said at least one sub-array are disposed to not allow grating lobes within a predetermined angle of scan.

5. The antenna of claim 1 wherein said at least one array of each of the unit cells comprises:

a second array of elements; and a third array of elements;

and wherein said second arrays collectively form a second sub-array to receive said RF signal in a second sub-band of said frequency band and said third arrays collectively form a third sub-array to receive said RF signal in a third sub-band of said frequency band.

6. The antenna of claim 5 wherein said first sub-band comprises frequencies between 0.3 and 1.0 GHz, said second sub-band comprises frequencies between 1.0 and 3.5 GHz, and said third sub-band comprises frequencies between 3.5 and 12.4 GHz.

7. The antenna of claim 1 wherein said plurality of unit cells are disposed on a high-impedance surface.

8. The antenna of claim 7 wherein said high-impedance surface comprises:

a substrate; and a multiplicity of metallic patches disposed in a spaced apart relation on said a substrate;

wherein each of said metallic patches is coupled its respective adjacent metallic patches by a thin transmission line.

9. A phased array antenna system comprising:

a plurality of unit cells, each unit cell including:

a first array of antenna elements; and at least one additional array of antenna elements, interspersed within said first array of antenna elements;

wherein said unit cells are disposed such that said first arrays collectively form a first sub-array to receive a radio frequency (RF) signal in a first sub-band of a frequency band, and said at least one additional arrays collectively form a respective at least one additional sub-array to receive said RF signal in a respective at least one remaining sub-band of said frequency band;

a plurality of beamforming networks for combining the replicas of said RF signal received by the antenna elements of said first sub-array and said at least one additional sub-array to form a plurality of output beams.

10. The phased array system of claim 9 further comprising:

a low noise amplifier (LNA) bank for amplifying said replicas; and a plurality feed networks for coupling said replicas to a respective one of said plurality of beamforming networks; and an adaptive control processor for controlling said plurality of beamforming networks.

11. The phased array system of claim 9 wherein the antenna elements of said first sub-array and said at least one additional sub-array are selected from the group consisting of dipole elements, bow-tie elements, spiral elements, and micro-strip patches.

12. The phased array system of claim 9 wherein the antenna elements of said first sub-array and said at least one additional sub-array are disposed one-half of one free-space wavelength apart.

13. The phased array system of claim 9 wherein the antenna elements of said first sub-array and said at least one additional sub-array are disposed to not allow grating lobes within a predetermined angle of scan.

14. The phased-array system of claim 9 wherein said at least one array of each of the unit cells comprises:

a second array of antenna elements; and a third array of antenna elements;

and wherein said second arrays collectively form a second sub-array to receive said RF signal in a second sub-band of said frequency band and said third arrays collectively form a third sub-array to receive said RF signal in a third sub-band of said frequency ban.

15. The phased array system of claim 14 wherein said first sub-band comprises frequencies from 0.3 to 1.0 GHz, said second sub-band comprises frequencies between 1.0 GHz to 3.5 GHz, and said third sub-band comprises frequencies between 3.5 GHz and 12.4 GHz.

16. The phased array system of claim 9 wherein said plurality of unit cells are disposed on a high-impedance surface.

17. The phased array system of claim 16 wherein said high-impedance surface comprises:

a substrate; and a multiplicity of metallic patches disposed in a spaced apart relation on said substrate;

wherein each of said metallic patches is coupled its respective adjacent metallic patches by a thin transmission line.

* * * * *